US005903219A

United States Patent [19]

Chen

[11] Patent Number: 5,903,219

[45] Date of Patent: May 11, 1999

[54] PERSONAL SECURITY DEVICE

[76] Inventor: Horng Wei Chen, 94, Kuokang, Kuokang Tsun, Kouhu Hsiang, Yunlin Hsien, Taiwan

[21] Appl. No.: 09/030,739

[22] Filed: Feb. 25, 1998

[51] Int. Cl.[6] ..... G08B 13/00

[52] U.S. Cl. ..... 340/574; 340/568.4; 340/691.1; 340/693.5; 200/50.31

[58] Field of Search ..... 340/573.1, 574, 340/568.4, 691.1, 693.5; 200/50.28, 50.29, 50.31, 51.12, 467, 546, 283

[56] References Cited

U.S. PATENT DOCUMENTS

| | | | |
|---|---|---|---|
| 4,665,389 | 5/1987 | Clendening | 340/574 |
| 5,325,085 | 6/1994 | Decker | 340/574 |
| 5,512,881 | 4/1996 | Majmudar | 340/574 |
| 5,517,180 | 5/1996 | Masi et al. | 340/573.1 |
| 5,617,075 | 4/1997 | Worth et al. | 340/574 |

*Primary Examiner*—Daniel J. Wu
*Attorney, Agent, or Firm*—Pro-Techtor International Services

[57] ABSTRACT

A personal security device having a box holding a circuit board, a siren, a first jack, a battery holder, a second jack, a switch and a lamp, a control plug for connecting to the first jack to turn off the siren, the control plug being attached with a swivel hook for hanging a key-ring, and a plug and switch unit, the plug and switch unit including a plug for connecting to the second jack to turn off the siren, a switch assembly, and a cord connected between the plug and the switch assembly, the switch assembly of the plug and switch unit having a switch box, and two metal spring plates partially extending out of the switch box, the metal spring plates of the switch assembly turning off the circuit of the plug of the plug and switch unit when squeezed toward each other, or turning on the circuit of the plug of the plug and switch unit when released, the siren being triggered to produce an audio alarm signal when the control plug or the plug of the plug and switch unit is disconnected from the box.

2 Claims, 9 Drawing Sheets

PERSONAL SECURITY DEVICE

BACKGROUND OF THE INVENTION

The present invention relates to a security device designed for personal use, and more particularly to such a personal security device which automatically produces an audio alarm signal when the protected personal item is robbed by a robber, or a control plug is pulled away from the box of the security device.

A woman may carry a whistle, a gas sprayer, a burglar alarm, etc. for use in an emergency to ask for help or for protection against a burglar. When threatened or frightened by a burglar, a woman usually dare not to use a whistle to ask for help. The drawback of using a gas sprayer for protection against a burglar is its limited effective range. Further, regular burglar alarms are commonly heavy and expensive, and not practical for personal use.

SUMMARY OF THE INVENTION

The present invention has been accomplished under the circumstances in view. It is one object of the present invention to provide a security device which is practical for personal use. It is another object of the present invention to provide a personal security device which automatically provides an audio alarm signal when the protected personal item is robbed by a robber. It is still another object of the present invention to provide a personal security device which can be used as a portable illuminator. It is still another object of the present invention to provide a personal security device which is easy to operate. To achieve these and other objects of the present invention, there is provided a personal security device comprised of a box holding a circuit board, a siren, a first jack, a battery holder, a second jack, a switch, and a lamp, the circuit board being connected to the siren and the battery holder, the first jack and the second jack being mounted on the circuit board, the lamp being connected to the circuit board through the switch; a control plug for connecting to the first jack to turn off the siren, the control plug being attached with a swivel hook for hanging a key-ring; and a plug and switch unit, the plug and switch unit comprising a plug for connecting to the second jack to turn off the siren, a switch assembly, and a cord connected between the plug and switch assembly of the plug and switch unit, the switch assembly of the plug and switch unit comprising a switch box, and two metal spring plates mounted in the switch box, the metal spring plates of the switch assembly of the plug and switch unit turning off the circuit of the plug of the plug and switch unit when squeezed toward each other, or turning on the circuit of the plug of the plug and switch unit when released. The siren is turned on when the box is pulled away from the control plug or the plug and switch unit with the protected object by a robber.

DETAILED DESCRIPTION OF THE PREFERRED EMBODIMENT

Figure 1:
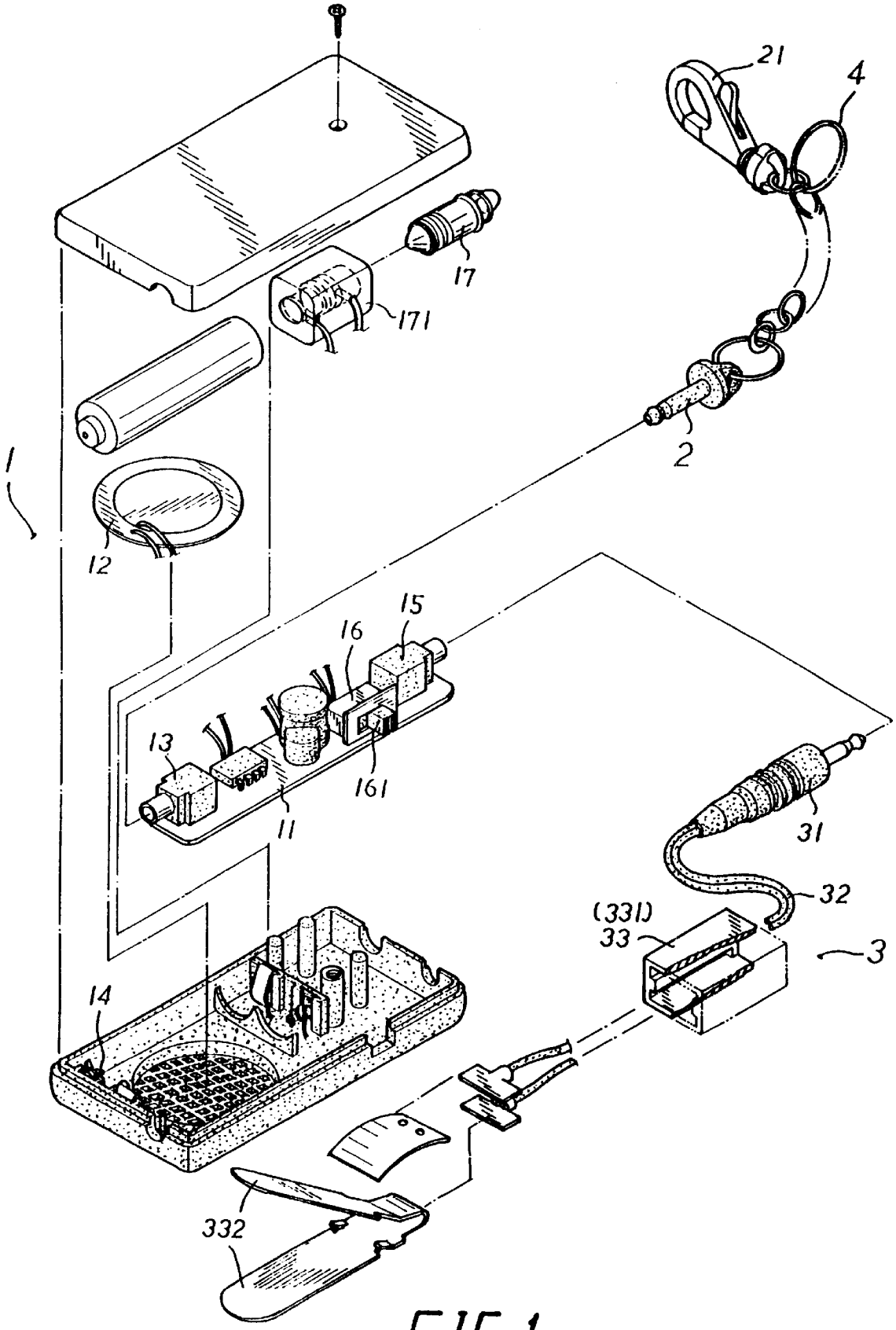
FIG. 1 is an exploded view of a security device according to one embodiment of the present invention.
Figure 2:
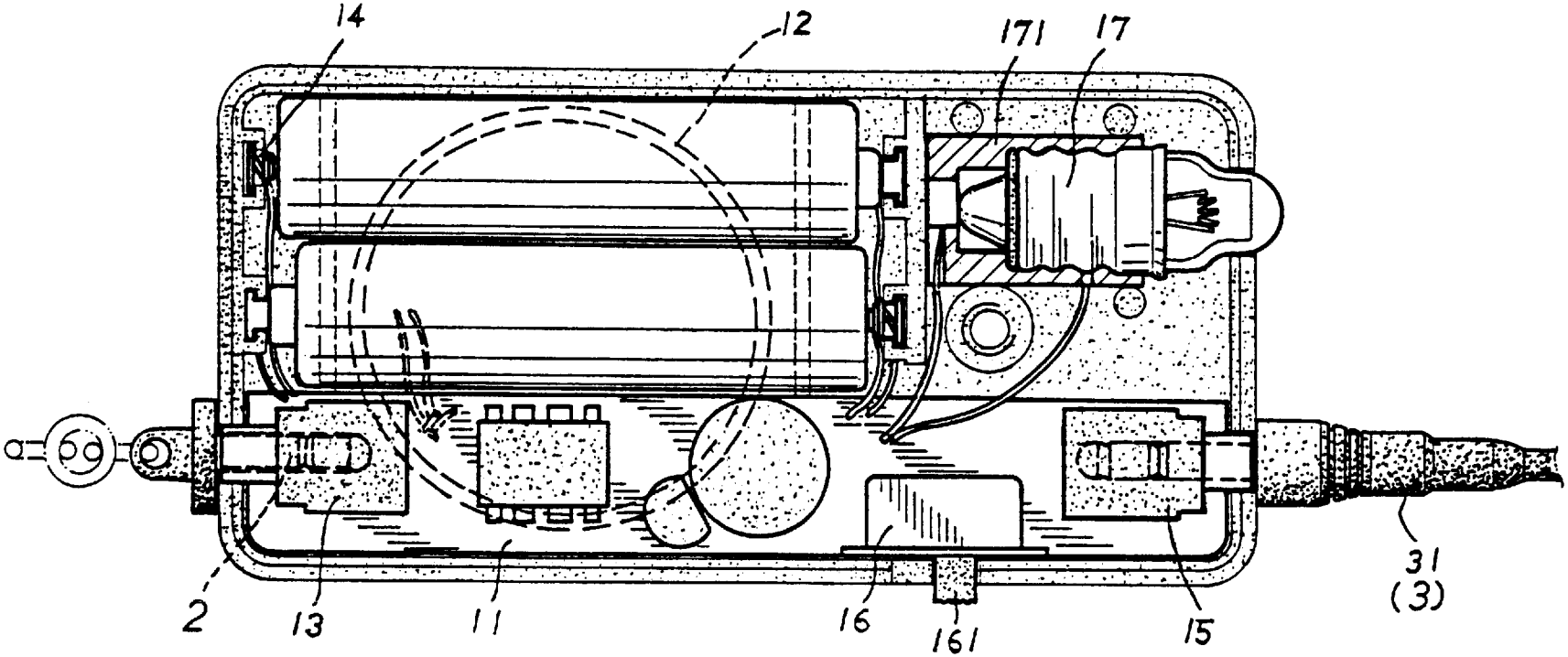
FIG. 2 is a top view in section showing the security device assembled.

Referring to FIGS. 1 and 2, a security device in accordance with the present invention is generally comprised of a box 1, a plug 2, and a plug and switch unit 3.

Figure 4A:
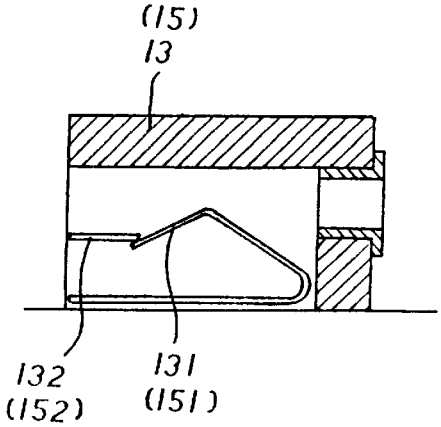
FIG. 4A is a sectional view of the jack according to the present invention.
Figure 4B:
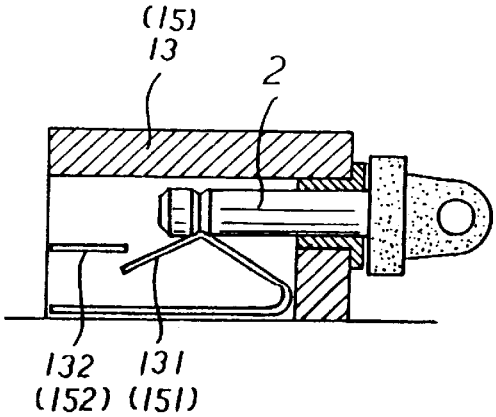
FIG. 4B is similar to FIG. 4B but showing the plug inserted into the jack, the circuit broken.
Figure 10:
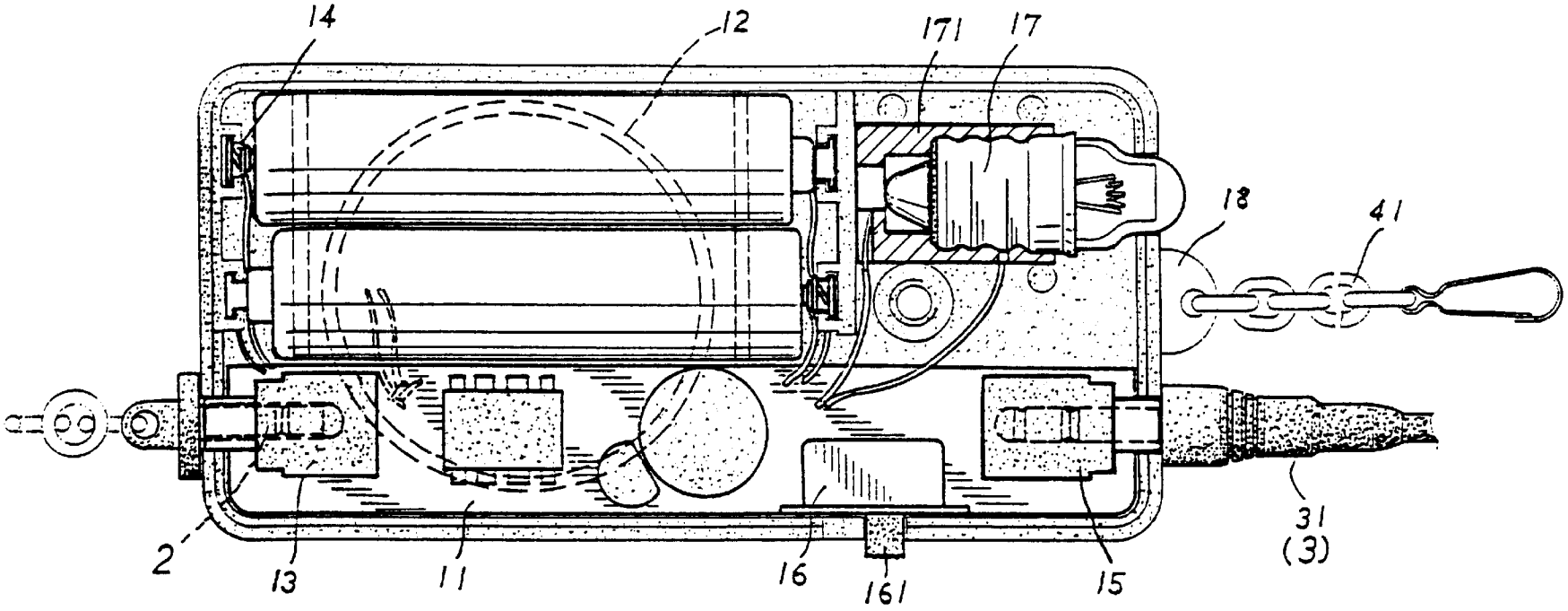
FIG. 10 is a top view in section of the present invention, showing a hanger fastened to the lug on the box of the security device.
Figure 11:
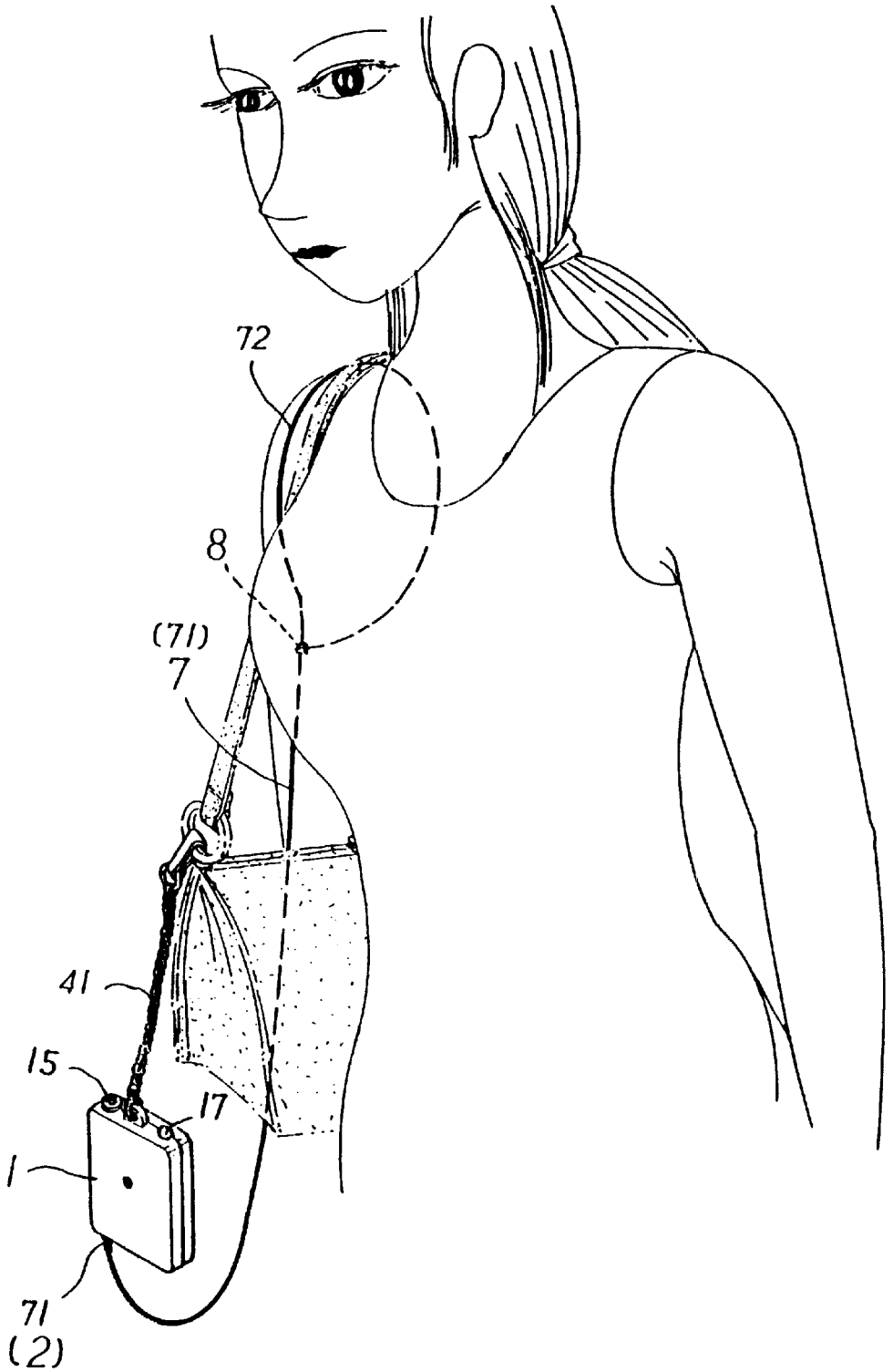
FIG. 11 shows still another application example of the present invention when used with a hanging rope.
Figure 13:
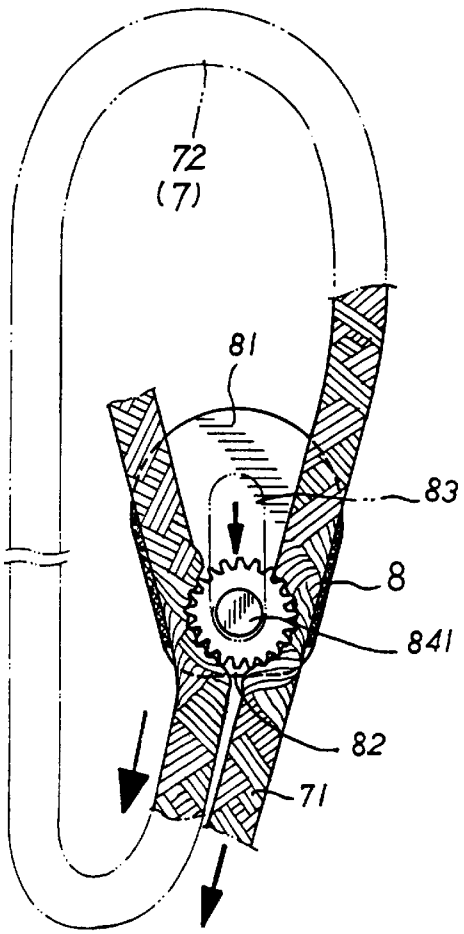
FIG. 13 is similar to FIG. 12 but showing the gear moved from the unlocking position to the locking position.
Figure 12:
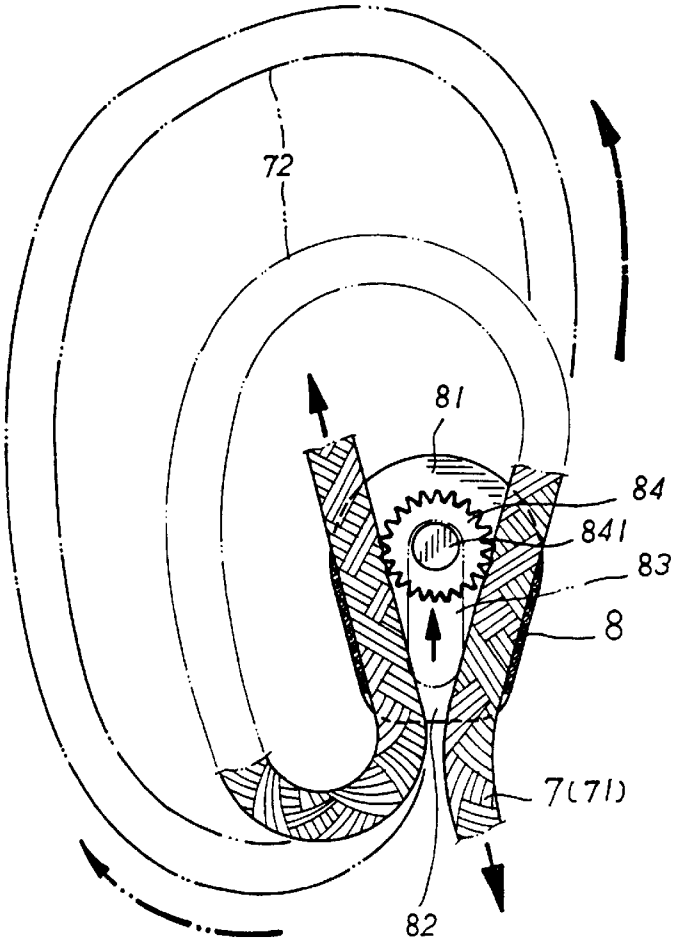
FIG. 12 shows the arrangement of the retainer on the hanging rope according to the present invention.

The box 1 is comprised of two cover shells fastened together, and holds a circuit board 11, a siren 12, a first jack 13, a battery holder 14, a second jack 15, a switch block 16, and a lamp 17. The circuit board 11, the siren 12 and the battery holder 14 are connected together by conductors. The first jack 13, the second jack 15 and the switch block 16 are directly mounted on the circuit board 11. The first jack 13 and the second jack 15 are provided at two opposite ends of the circuit board 11. The first jack 13 comprises a first metal spring plate 131 and a second metal spring plate 132 retained in contact with each other to close the circuit (see FIG. 4A). The second jack 15 comprises a first metal spring plate 151 and a second metal spring plate 152 retained in contact with each other to close the circuit (see FIG. 4A). When the plug 2 is inserted into the first jack 13, the first metal spring plate 131 is deformed and disconnected from the second metal spring plate 132, thereby causing the circuit of the first jack 13 to be broken (see FIG. 4B). The switch block 16 comprises a switching lever 161 for switching control. The switch block 16 is connected to the lamp socket 171 of the lamp 17. By means of operating the switching lever 161, the lamp 17 is turned on/off. A lug 18 is provided at the box 1 (see FIG. 10) for mounting a hanger 41 or the like (see FIG. 11).

Figure 5:
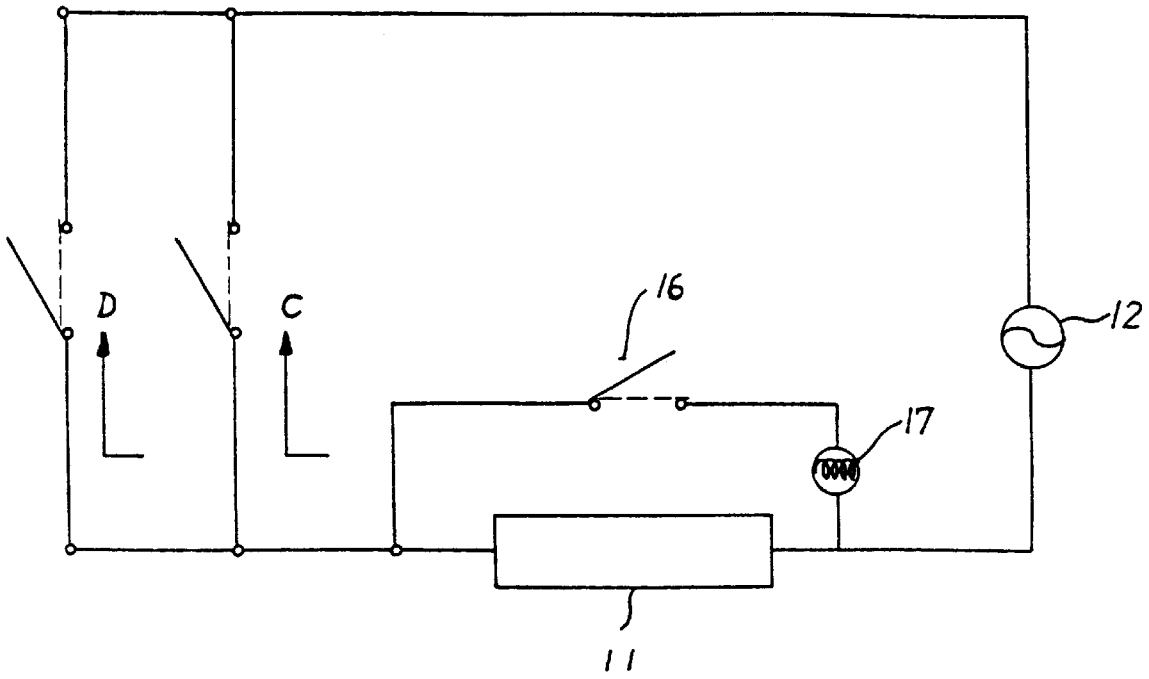
FIG. 5 is a circuit diagram of the present invention.

The plug 2 is mounted with a swivel hook 21 for hanging a key-ring 4 or the like. When the plug 2 is inserted into the first jack 13, the internal circuit of the first jack 13 is off. When the plug 2 is disconnected from the socket 13, the internal circuit of the first jack 13 is on, thereby causing the siren 12 to be turned on (see loop C in FIG. 5).

Figure 3:
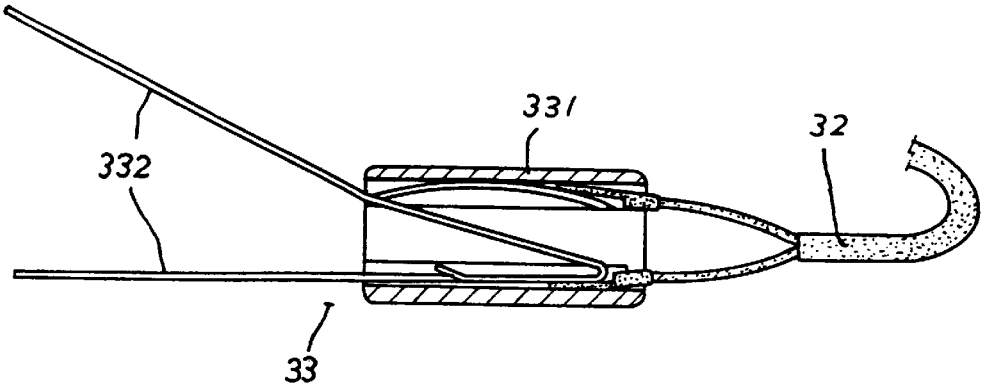
FIG. 3 is a sectional assembly view of a part of the plug and switch assembly according to the present invention.
Figure 6A:
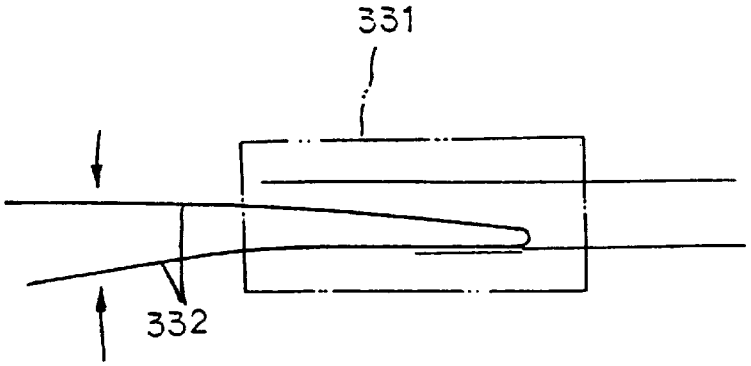
FIG. 6A is a schematic drawing showing the open circuit status of the switch assembly of the plug and switch assembly according to the present invention.
Figure 6B:
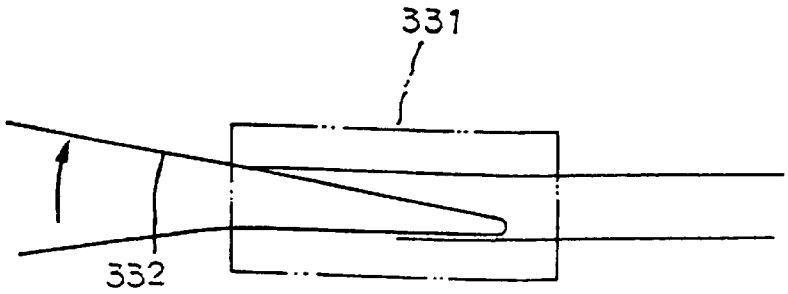
FIG. 6B is a schematic drawing showing the close circuit status of the switch assembly of the plug and switch assembly according to the present invention.

The plug and switch unit 3 comprises a plug 31, a switch assembly 33, and a cord 32 connected between the plug 31 and the switch assembly 33. The switch assembly 33 comprises a switch box 331, and two metal spring plates 332 mounted in the switch box 331. The metal spring plates 332 partially extend out of the switch box 331. When the metal spring plates 332 are compressed (see FIG. 6A), the circuit is broken. When the metal spring plates 332 are released, they immediately return to their former shape to contact two terminals inside the switch box 331 and to close the circuit (see FIGS. 3 and 6B), thereby causing the siren 12 to function (see loop D in FIG. 5). If the plug 31 is disconnected from the second jack 15, the circuit of the second jack 15 is closed (see FIG. 4A), and the siren 12 is turned on.

Figure 7:
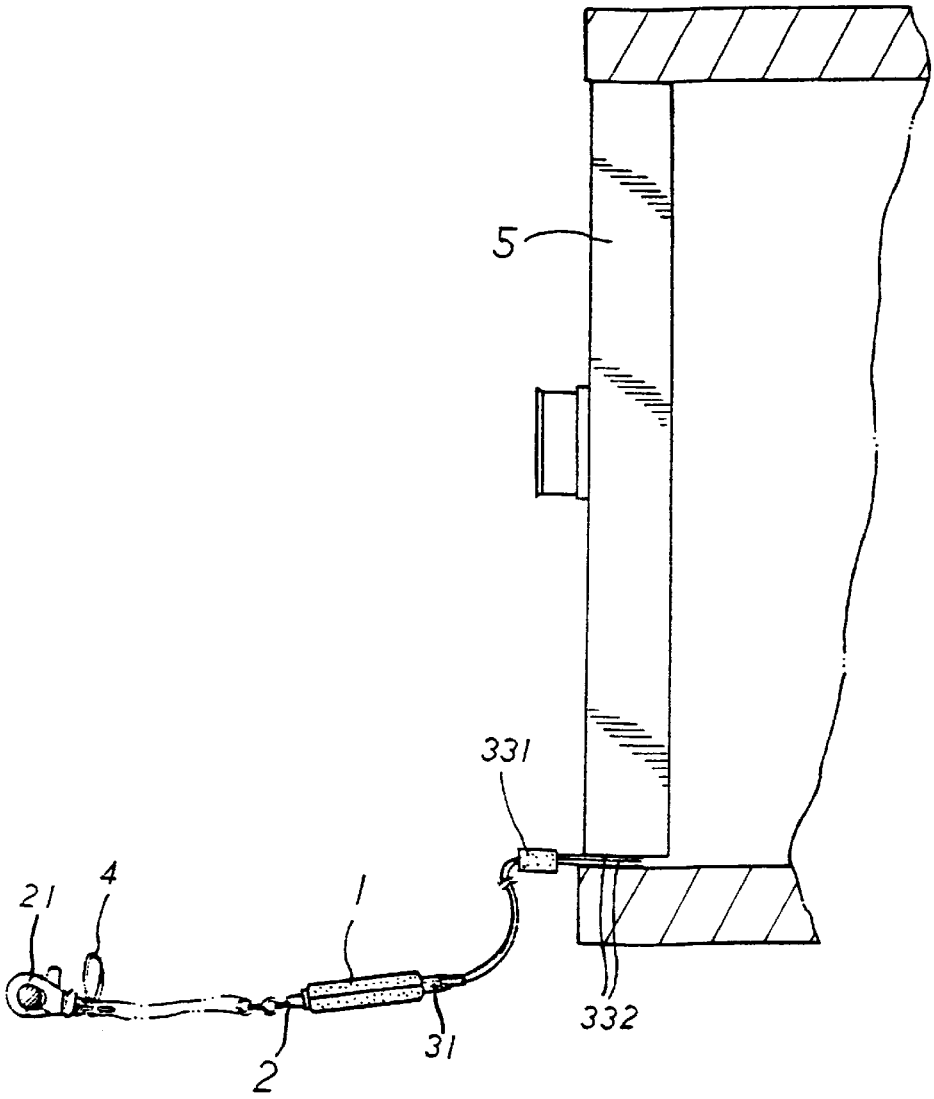
FIG. 7 shows an application example of the present invention.
Figure 8:
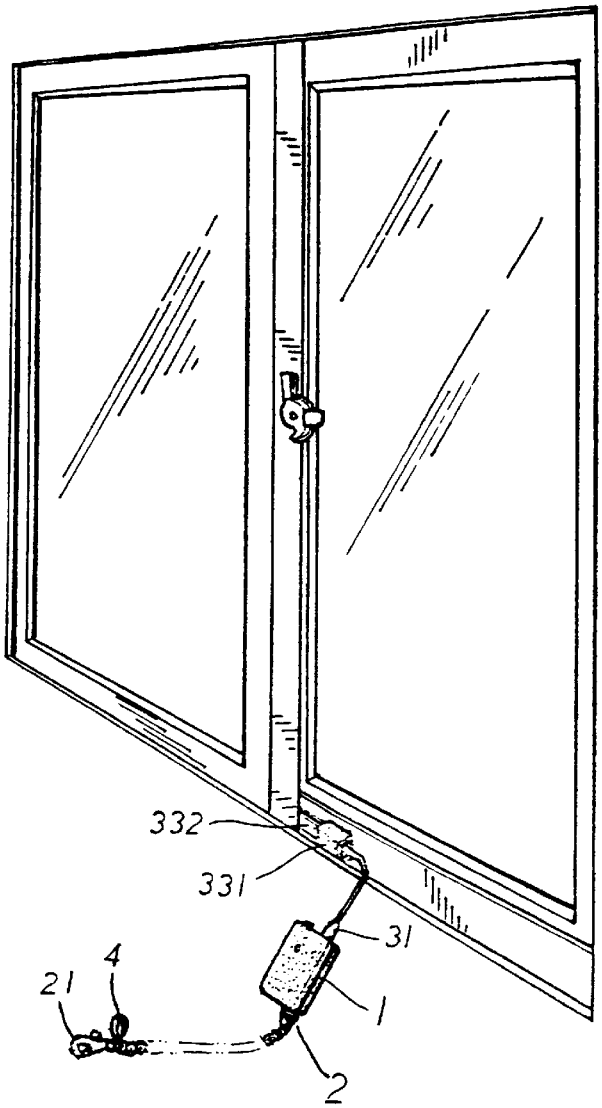
FIG. 8 shows another application example of the present invention.

When the box 1 and the plug 2 are fastened together, the siren 12 is off. When the plug 2 is disconnected from the box 1 during an emergency, the siren 12 is turned on to provide an audio alarm signal. When the plug and switch unit 3 is installed in the box 1, the metal spring plates 332 can be retained at the bottom of an object 5 (see FIG. 7) or inserted in a gap between two window panels (see FIG. 8). When the object 5 is moved out of place or the window panels are opened, the metal spring plates 332 are released to close the circuit, thereby causing the siren 12 to be turned on. If the plug and switch unit 3 is forced away from the box 1, the circuit is automatically closed (see loop C in FIG. 5), thereby causing the siren 12 to function.

Figure 9:
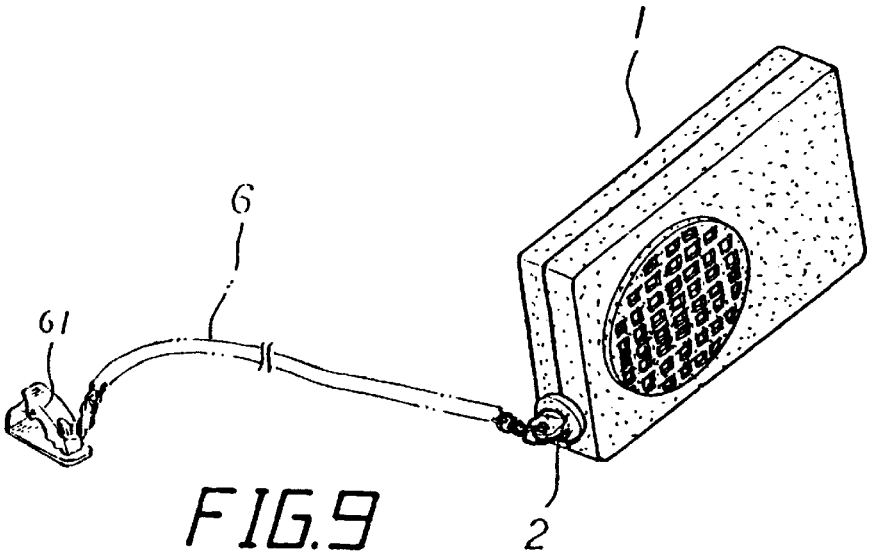
FIG. 9 shows a chain with a clip connected to the plug at one side of the box of the security device according to the present invention.

Referring to FIG. 9, a chain 6 may be used and connected to end of the plug 2. The chain 6 has a clip 61 at one end for fastening to the user's personal item (belt, clothe, etc.) or motorcycle. When in use, the box 1 is put in or hung on user's handbag, and the clip 61 of the chain 6 is fastened to the user's personal item. If the user's handbag is robbed by a robber, the box 1 is disconnected from the plug 2, thereby causing the siren 12 to function. Further, through the switching lever 161, the lamp 17 can be turned on to give off light.

Referring to Figures from 10 to 13, a hanging rope 7 is provided having one end 71 connected to the plug 2, and an opposite end arranged into a loop 72 and secured in shape by a retainer 8. The retainer 8 is a hollow shell having a big hole 81 at one side, a small hole 82 at an opposite side, an elongated slot 83 on the middle, a gear 841 mounted on the inside and coupled to the elongated slot 83 by a bolt 841. The gear 841 can be moved along the elongated slot 83 between the big hole 81 and the small hole 82. When the gear 84 is moved along the elongated slot 83 from the small hole 82 to the big hole 81, the hanging rope 7 is released from the retainer 8 and can be moved in the retainer 8 to adjust the size of the loop 72. When the gear 84 is moved along the elongated slot 83 from the big hole 81 to the small hole 82, the hanging rope 7 is jammed, and the loop 72 is fixed. When in use, the loop 72 of the hanging rope 7 can be hung on the user's neck, the box 1 can be hung on the user's handbag by a hanger 41. If the user's handbag is robbed by a robber, the box 1 is pulled with the handbag and disconnected from the plug 2 which is connected to the hanging rope 7, thereby causing the siren 12 to function.

It is to be understood that the drawings are designed for purposes of illustration only, and are not intended as a definition of the limits and scope of the invention disclosed.

What the invention claimed is:

1. A personal security device comprising:

a box holding a circuit board, a siren, a first jack, a battery holder, a second jack, a switch, and a lamp, said circuit board being connected to said siren and said battery holder, said first jack and said second jack being mounted on said circuit board and retained in a respective hole on said box, said lamp being connected to said circuit board through said switch;

a control plug for connecting to said first jack to turn off said siren, said control plug being attached with a swivel hook for hanging a key-ring; and a plug and switch unit, said plug and switch unit comprising a plug for connecting to said second jack to turn off said siren, a switch assembly, and a cord connected between the plug and switch assembly of said plug and switch unit, the switch assembly of said plug and switch unit comprising a switch box, and two metal spring plates mounted in said switch box, the metal spring plates of the switch assembly of said plug and switch unit turning off the circuit of the plug of said plug and switch unit when squeezed toward each other, or turning on the circuit of the plug of said plug and switch unit when released.

2. The personal security device of claim 1 further comprising a hanging rope, said hanging rope having one end connected to said control plug, and an opposite end arranged into a loop and secured in shape by a retainer thereof, said retainer comprising a hollow shell having a big hole at one side, a small hole at an opposite side, an elongated slot on the middle, a gear mounted on the inside and coupled to said elongated slot by a bolt, said gearing being moved along said elongated slot between said big hole and said small hole, said hanging rope being released from said retainer and allowed to be moved in said big hole and said small hole to adjust the size of said loop when said gear is moved along said elongated slot from said small hole to said big hole, said hanging rope being jammed in said small hole and said loop being fixed when said gear is moved along said elongated slot from said big hole to said small hole.

* * * * *